US008875549B2

(12) United States Patent
Chang et al.

(10) Patent No.: US 8,875,549 B2
(45) Date of Patent: Nov. 4, 2014

(54) LOCK ASSEMBLY

(71) Applicant: Door & Window Hardware Co., Taichung (TW)

(72) Inventors: Wei-Hung Chang, Taichung (TW); Chih-Lun Hsieh, Taichung (TW)

(73) Assignee: Door & Window Hardware Co., Taichung (TW)

( * ) Notice: Subject to any disclaimer, the term of this patent is extended or adjusted under 35 U.S.C. 154(b) by 76 days.

(21) Appl. No.: 13/659,569

(22) Filed: Oct. 24, 2012

(65) Prior Publication Data

US 2014/0109635 A1 Apr. 24, 2014

(51) Int. Cl.
*E05B 59/00* (2006.01)
*E05B 63/14* (2006.01)

(52) U.S. Cl.
USPC ..... 70/107; 70/110; 70/134; 292/34

(58) Field of Classification Search
CPC ..... E05B 55/00; E05B 55/005; E05B 59/00; E05B 63/00; E05B 63/0017; E05B 63/08; E05B 2063/00; E05B 2063/18
USPC ..... 70/106–111, 134, 150, 480–485; 292/33, 34, 36, 37, 40
See application file for complete search history.

(56) References Cited

U.S. PATENT DOCUMENTS 3,672,714 A * 6/1972 Schultz ..... 70/107
5,265,920 A 11/1993 Kaup et al.
5,267,457 A 12/1993 Sorensen et al.
5,301,525 A 4/1994 Doring
5,765,410 A * 6/1998 Kwan et al. ..... 70/107
5,782,114 A 7/1998 Zeus et al.
5,819,562 A 10/1998 Christ
5,878,605 A 3/1999 Renz
6,131,966 A 10/2000 Hensley et al.
6,266,981 B1 7/2001 von Resch et al.
6,536,245 B2 * 3/2003 Chiang ..... 70/107
6,581,423 B2 * 6/2003 Lin ..... 70/107
6,622,535 B2 * 9/2003 Chiang et al. ..... 70/107
6,669,245 B2 12/2003 Ruano Aramburu et al.
6,810,699 B2 11/2004 Nagy
6,851,287 B1 2/2005 Yang et al.
7,003,990 B2 2/2006 Iliuk
7,007,985 B2 * 3/2006 Alexander et al. ..... 70/107
7,303,215 B2 * 12/2007 Moon et al. ..... 70/107
7,661,279 B2 2/2010 Huang et al.
7,856,857 B2 * 12/2010 Tsai ..... 70/107
8,079,238 B2 * 12/2011 Lin ..... 70/107
2002/0053227 A1 5/2002 Chiang et al.
2002/0104339 A1 8/2002 Saner
2003/0106350 A1 6/2003 Char et al.
2003/0159478 A1 8/2003 Nagy

* cited by examiner

*Primary Examiner* — Christopher Boswell
(74) *Attorney, Agent, or Firm* — Birch, Stewart, Kolasch & Birch, LLP

(57) ABSTRACT

A lock assembly has a body, a latching device, a linking device and a locking mechanism. The linking device is connected to and driven by the latching device. The locking mechanism is moveably mounted in the body and has a bolt base, a pushing element, a lever element and a locking bolt. The bolt base is mounted slidably in the body. The locking bolt is slidably mounted on the bolt base and is driven to retract into or completely extends out from the body with the transmission of the pushing element and the lever element.

14 Claims, 5 Drawing Sheets

LOCK ASSEMBLY

BACKGROUND OF THE INVENTION

1. Field of the Invention

The present invention relates to a lock assembly, and more particularly to a lock assembly that can be locked actually and securely.

2. Description of Related Art

A conventional lock as U.S. Pat. No. 7,661,279, entitled "Lock Assembly" comprises a locking mechanism connected with and driven by a locking cylinder and having a locking bolt. When the locking cylinder is rotated, the locking bolt of the locking mechanism will be pushed to extend out of or retract into a body by a pushing lug of the locking cylinder.

However, the locking bolt of the '279 patent is pushed to extend out of the body by the rotation of the locking cylinder and the pivotal rotation of the pushing lug, and the travel path of the pivotal rotation of the pushing lug may not be sufficient to push the locking bolt to completely extend out of the body. Therefore, a bolt spring is necessary for the '279 patent to provide a pushing force to the locking bolt as so to ensure that the locking bolt can actually extend out of the body to the locking position. However, the locking bolt may not actually extend to the locking position with the force of the bolt spring when a drag force or a large friction force is applied to the locking bolt. Furthermore, when the locking bolt is not at the locking position, the user cannot be immediately aware of the situation merely from the appearance of the lock assembly, so the safety of the use of the conventional lock assembly is insufficient.

To overcome the shortcomings, the present invention tends to provide a lock assembly to mitigate or obviate the aforementioned problems.

SUMMARY OF THE INVENTION

The main objective of the invention is to provide a lock assembly that can actually hold the lock assembly at a locked condition stably.

The lock assembly has a body, a latching device, a linking device and a locking mechanism. The latching device is mounted in the body and has a latch and a connecting device. The latch is mounted retractably in the body and can extend out from the body. The connecting device is connected to the latch to retract the latch into the body. The linking device is mounted in the body, is connected to and driven by the connecting device of the latching device. The locking mechanism is moveably mounted in the body and has a bolt base, a base spring, a pushing element, a lever element and a locking bolt. The bolt base is mounted slidably in the body. The base spring is mounted on the body and has two ends connected respectively to the body and the bolt base. The pushing element is moveably mounted on the bolt base. The lever element is pivotally connected to the body and is connected moveably to the pushing element. The locking bolt is slidably mounted on the bolt base and is connected moveably to and pushed by the lever element.

Other objects, advantages and novel features of the invention will become more apparent from the following detailed description when taken in conjunction with the accompanying drawings.

DETAILED DESCRIPTION OF PREFERRED EMBODIMENT

Figure 1:
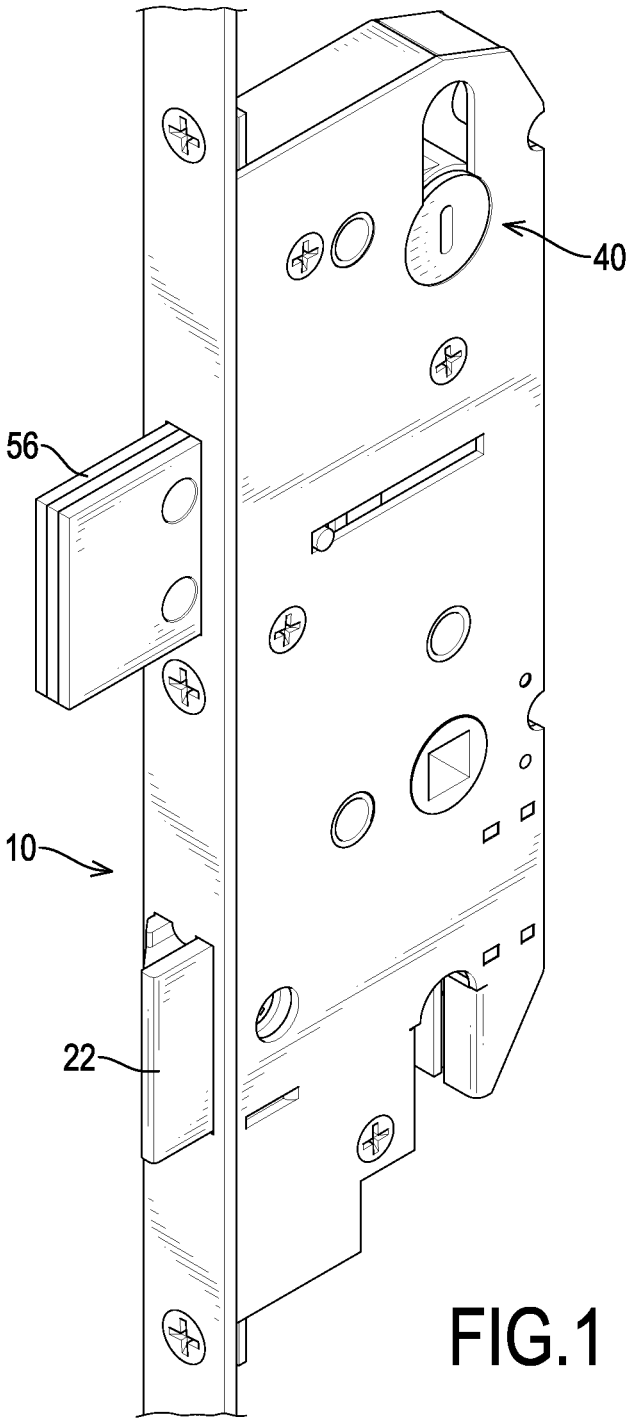
FIG. 1 is a perspective view of a lock assembly in accordance with the present invention.
Figure 2:
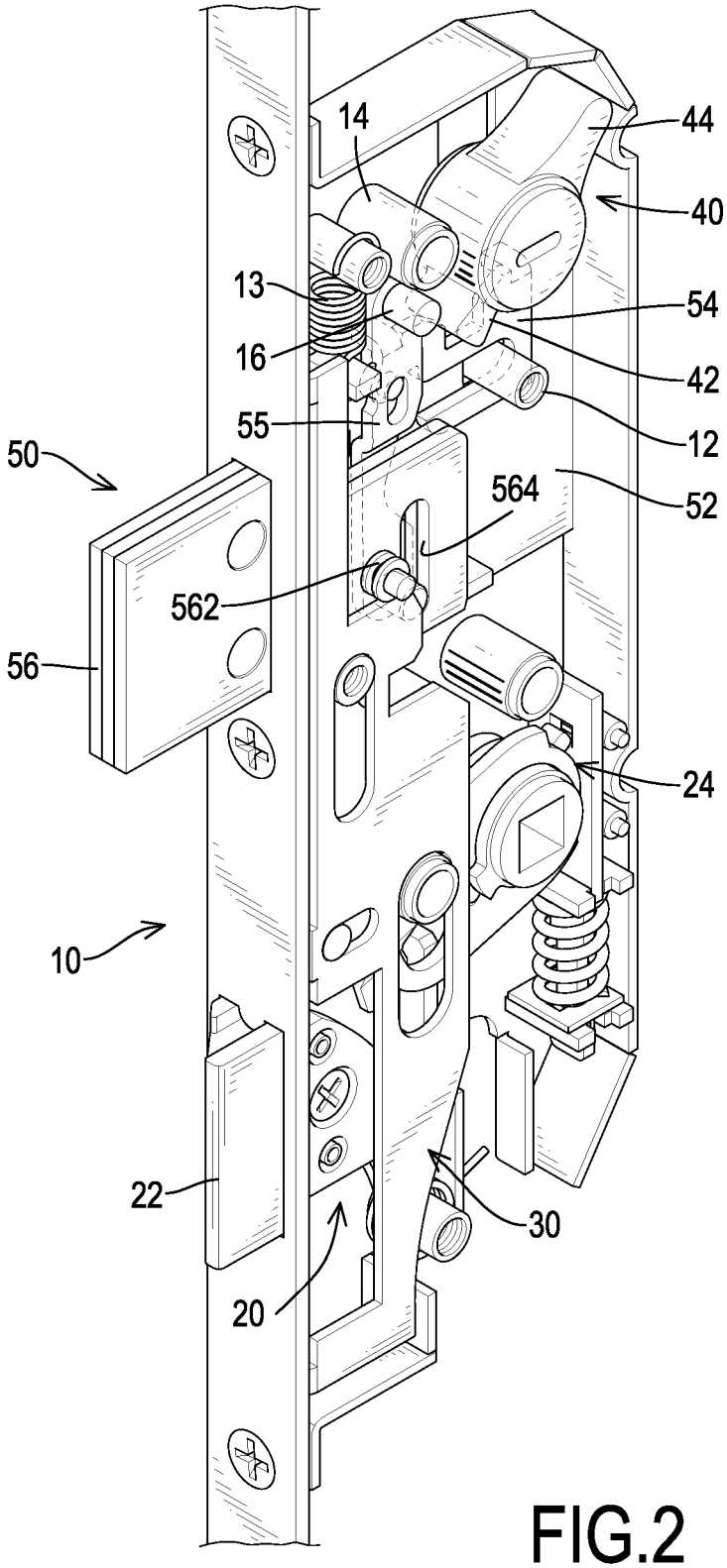
FIG. 2 is a perspective view of the lock assembly in FIG. 1 with the cover removed.
Figure 3:
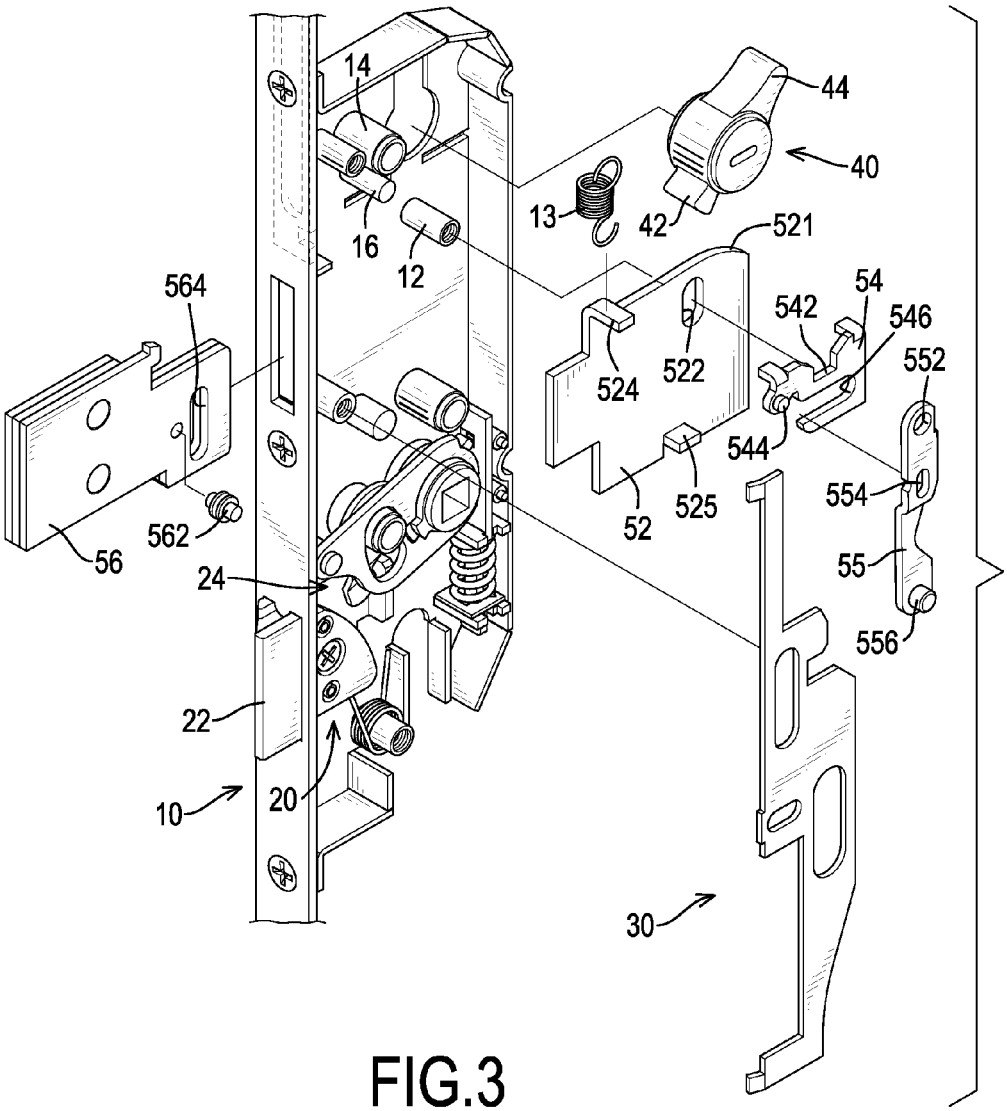
FIG. 3 is an exploded perspective view of the lock assembly in FIG. 2.

With reference to FIGS. 1 to 3, a lock assembly in accordance with the present invention comprises a body 10, a latching device 20, a linking device 30 and a locking mechanism 50. The body 10 is securely attached to a door panel, is hollow and may be implemented by a base and a cover. The latching device 20 is mounted in the body 10 and comprises a latch 22 and a connecting device 24. The latch 22 is mounted retractably in the body, and can extend out from the body 10 and selectively into a latch recess in a doorframe to close the door panel with respect to the doorframe. The connecting device 24 is mounted in the body 10 and is connected to the latch 22 to retract the latch 22 into the body. The linking device 30 is mounted in the body 10, is connected to and driven by the connecting device 24 of the latching device 20 and is connected with two auxiliary locks to lock or unlock the auxiliary locks. The structures of the body 10, the latching device 20, the linking device 30 and the auxiliary locks and the means of locking and unlocking the auxiliary locks by the linking device 30 may be conventional and not the subject matter of the present invention, so detail description about the auxiliary lock is omitted.

The locking mechanism 50 is moveably mounted in the body 10 and is preferably driven by a locking cylinder 40. The locking cylinder 40 is mounted operationally in the body 10, can be driven by a key, a thumb turn or the like and has a pushing lug 42 mounted on the locking cylinder 40. The locking cylinder 40 may be in different types and may further have a stop 44 formed on the locking cylinder 40. The body 10 further has a stopping post 14 formed on the body 10 and selectively abutting the stop 44 on the locking cylinder 40 to limit the rotating range of the locking cylinder 40.

The locking cylinder 40 and the locking mechanism 50 can be mounted near the top of the body 10 and are located above the latching device 20. Alternatively, the locking cylinder 40 and the locking mechanism 50 can be mounted near the bottom of the body 10 and are located under the latching device 20.

The locking mechanism 50 comprises a bolt base 52, a pushing element 54, a lever element 55 and a locking bolt 56. The bolt base 52 is mounted slidably in the body 10 at a position corresponding to the locking cylinder 40. The bolt base 52 has an edge 521 abutting the pushing lug 42 on the locking cylinder 40, and the edge 521 may be curved and may be formed as the top edge of the bolt base 52. In practice, the edge 521 abuts the pushing lug 42 at all time. Alternatively, the edge 521 may be spaced from the pushing lug 42 at an original position and abuts the pushing lug 42 after the locking cylinder 40 is rotated. In addition, when the locking mechanism 50 is mounted near the bottom of the body 10, the edge 521 is formed as the bottom edge of the bolt base 52.

To slidably mount the bolt base 52 in the body 10, the bolt base 52 has a base slot 522 defined longitudinally through the bolt base 52. The body 10 further has a guiding rod 12 formed on and protruding from the body 10 and extending slidably into the base slot 522 in the bolt base 52. A base spring 13 is mounted in the body 10 and has two ends connected respectively to the body 10 and the bolt base 52 to provide a force to pull the bolt base 52 to the original position. In addition, the bolt base 52 further has a limiting tab 525 and a guiding tab 524. A sliding space is defined between the limiting tab 52 and the guiding tab 524. Preferably, the limiting tab 525 is formed on the bottom edge of the bolt base 52, and the guiding tab 524 is formed on the top edge of the bolt base 52 and is connected to the base spring 13.

The pushing element 54 is mounted moveably on the bolt base 52 and selectively engages and is driven by the pushing lug 42 on the locking cylinder 40. Preferably, the pushing element 54 is mounted moveably around the guiding rod 12 on the body 10. The pushing element 54 has a guiding channel 546, a notch 542 and a pushing rod 544. The guiding channel 546 is elongated and is mounted slidably around the guiding rod 12. The notch 542 is defined in an edge of the pushing element 54 and selectively engages the pushing lug 42 on the locking cylinder 40. The pushing rod 544 is formed on and protrudes from an end of the pushing element 54.

The lever element 55 is elongated, is pivotally mounted on the body 10 and has a pivotal hole 552, a guiding hole 554 and a driving rod 556. The pivotal hole 552 is defined through one end of the lever element 55 and is mounted rotatably around a pivotal rod 16 formed on the body 10. The guiding hole 554 is elongated and is defined through the lever element 55 at a position near the pivotal hole 552 and is mounted slidably around the pushing rod 544 on the pushing element 54. The driving rod 556 is formed on and protrudes from the lever element 55 at an end opposite to the pivotal hole 552.

The locking bolt 56 is slidably mounted on the bolt base 52 in the sliding space, is connected movably to and pushed by the lever element 55 to be retractable into and extendable out from the body 10 so as to extend into a locking recess in the doorframe. The locking bolt 56 further has a bolt slot 564 defined longitudinally through the locking bolt 56 and being parallel with the base slot 522 in the bolt base 52. The driving rod 556 on the lever element 55 extends slidably into the bolt slot 564 in the locking bolt 56 to push the locking bolt 56 relative to the sliding space in the bolt base 52 when the lever element 55 is pivoted.

The locking bolt 56 may abut the limiting tab 525 on the bolt base 52 when the locking bolt 56 retracts completely into or extends out from the body 10. The locking bolt 56 may further have a blocking tab 562 formed on the locking bolt 56 to selectively abut and block the linking device 30. Preferably, the locking bolt 56 may be an integral single piece or be implemented by multiple boards.

Figure 4:
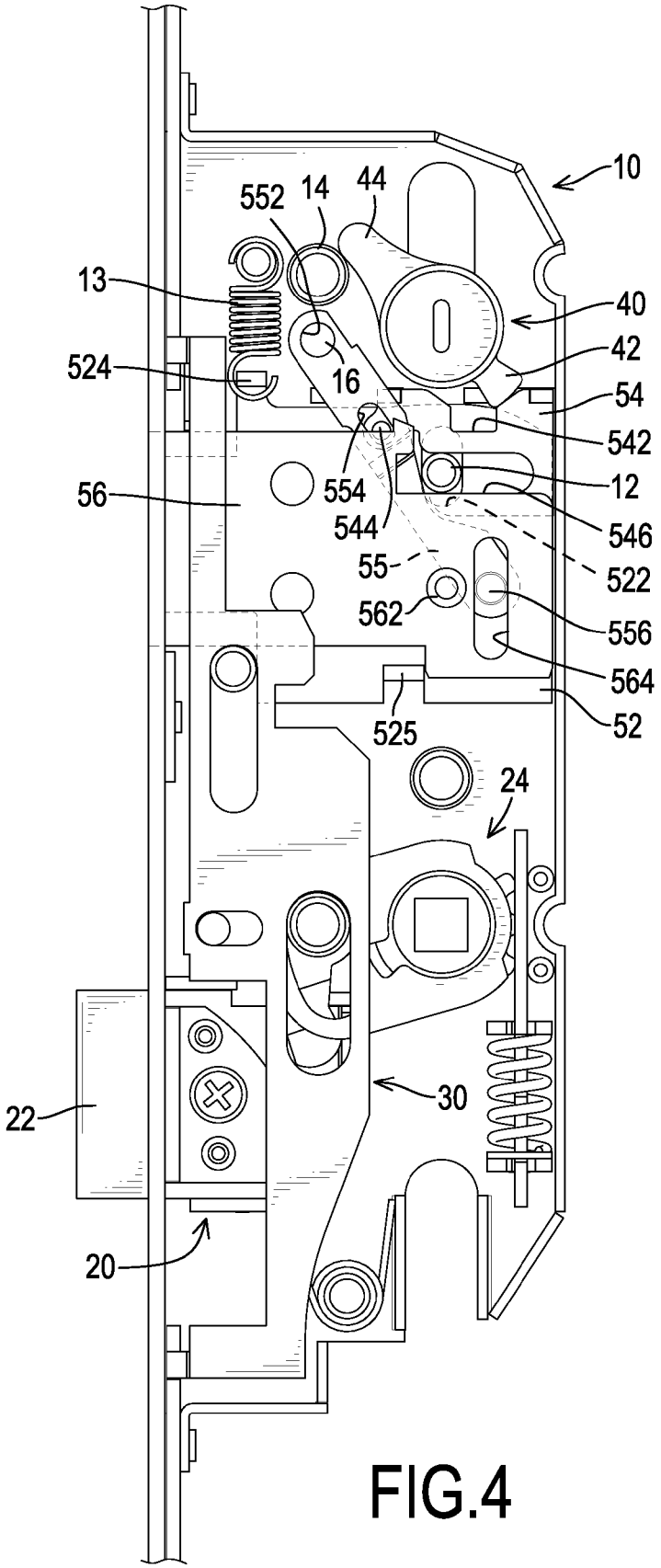
FIG. 4 is a side view of the lock assembly in FIG. 2.
Figure 5:
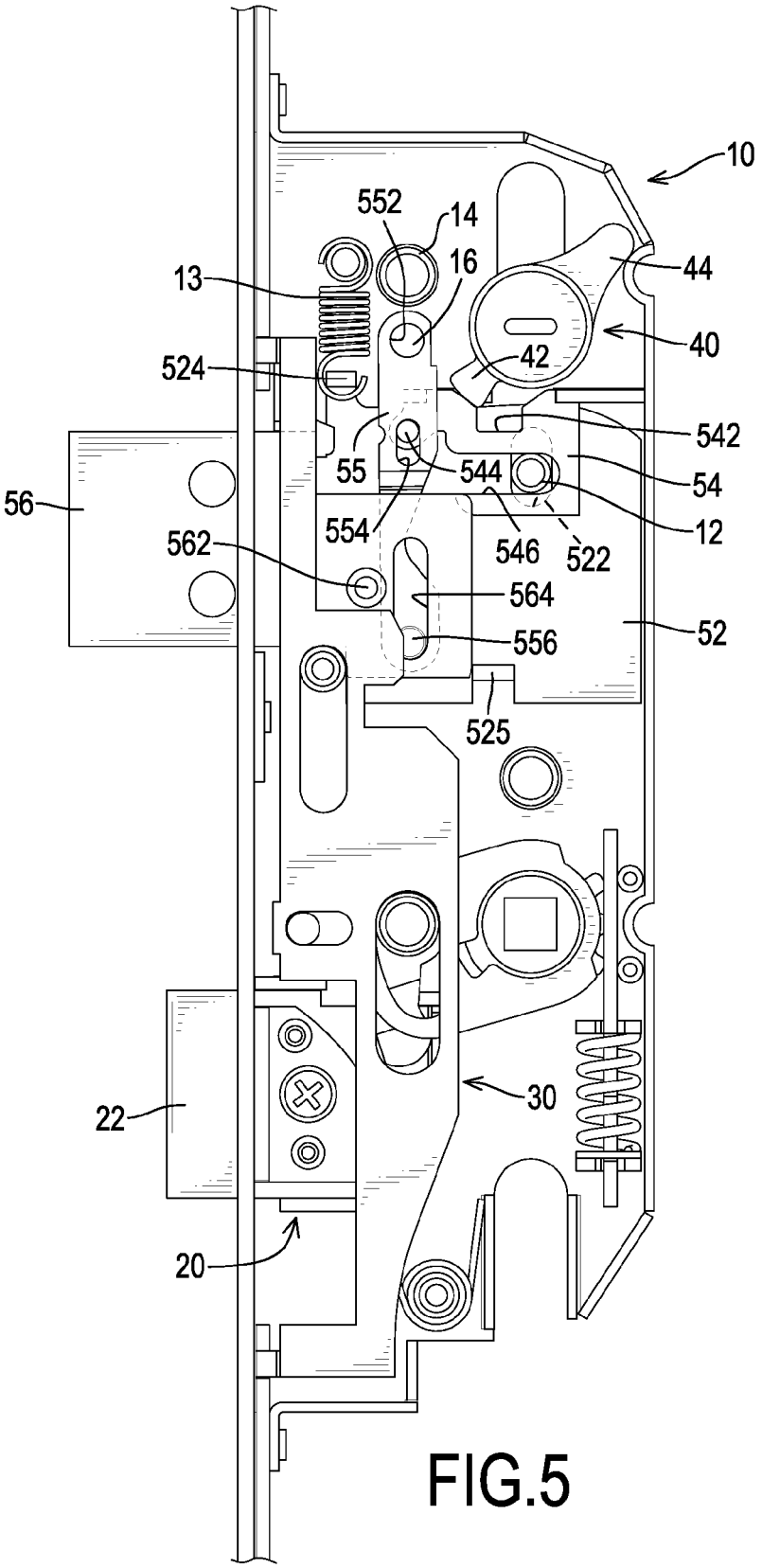
FIG. 5 is an operational side view of the lock assembly in FIG. 2 showing that the locking bolt is extended to make the lock assembly locked.

With reference to FIG. 4, when the lock assembly is in an unlocked condition, the locking bolt 56 abuts the limiting tab 525 on the bolt base 52. With further reference to FIG. 5, when the locking cylinder 40 is rotated with a specific key, the bolt base 52 is pushed to move downward by the pushing lug 42 on the locking cylinder 40. The limiting tab 525 will leave the position of abutment against the locking bolt 56. When the locking cylinder 40 is rotated, the pushing element 54 will be moved relative to the body 10 along the guiding channel 546 by the engagement of the pushing lug 42 and the notch 542. Consequently, the lever element 55 is pivoted relative to the body 10 by the pushing element 54 with the pushing rod 544 moving along the guiding hole 554. Accordingly, the locking bolt 56 will be extended out from the body 10 by the driving rod 556 moving along the bolt slot 564 to engage the locking recess in the doorframe, such that the lock assembly is locked.

Because the locking cylinder 40 drives the locking bolt 56 to move with the transmission of the moving pushing element 54 and the pivoting lever element 55, the movement travel of the locking bolt 56 can be prolonged by the pivoting lever element 55. Accordingly, the locking bolt 56 can completely and actually extend out of the body 10 to make the locked condition. In addition, a bolt spring is necessary. Furthermore, when a drag force or a large friction force is applied to the locking bolt 56, the user can be aware of this situation with the reaction force from the drag or friction force such that the reaction and friction forces can be immediately eliminated, and the safety of the use of the lock assembly is improved.

Moreover, when the locking cylinder 40 is rotated and the pushing lug 42 disengages from the notch 542, the bolt base 52 is moved upward due to the curved travel path of the pushing lug 42 and with the force provided by the base spring 13. The limiting tab 525 will move to a position corresponding to the locking bolt 56. Consequently, the locking bolt 56 cannot be retracted into the body 10 due to the abutment of the limiting tab 525, even if a huge force is applied to the locking bolt 56.

When the lock assembly is at a locked condition, the blocking tab 562 abuts or engages the linking device 30 to provide a blocking effect to the linking device 30. Accordingly, the linking device 30 is prevented from moving relative to the body 10, and the latching device 20 is kept from being operated. Therefore, the lock assembly will be kept at the locked condition stably.

When the locking cylinder 40 is rotated in reverse, the pushing lug 42 will push the bolt base 52 to move downward and to move the pushing element 54 and pivot the lever element 55 in reverse. Accordingly, the locking bolt 56 is then retracted into the body 10 by the transmission of the pushing element 54 and the lever element 55 to unlock the lock assembly.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock assembly comprising:

a body;

a latching device mounted in the body and comprising:

a latch mounted retractably in the body and capable of extending out of the body; and a connecting device connected to the latch to retract the latch into the body;

a linking device mounted in the body, connected to and driven by the connecting device of the latching device; and a locking mechanism moveably mounted in the body and comprising:

a bolt base mounted slidably in the body;

a base spring mounted on the body and having two ends connected respectively to the body and the bolt base;

a pushing element moveably mounted on the bolt base;

a lever element pivotally connected to the body and connected moveably to the pushing element; and a locking bolt slidably mounted on the bolt base and connected moveably to and pushed by the lever element, wherein:

the pushing element further includes a pushing rod protruding from an end of the pushing element; and the lever element is elongated and comprises:

a pivotal hole defined through one end of the lever element and mounted rotatably around a pivotal rod formed on the body; and an elongated guiding hole defined through the lever element at a position near the pivotal hole and mounted slidably around the pushing rod on the pushing element.

2. The lock assembly as claimed in claim 1, wherein the lock assembly further has a locking cylinder mounted operationally on the body to drive the locking mechanism moveable in the body and having a pushing lug mounted on the locking cylinder;

the bolt base further has an edge selectively abutting and pushed by the pushing lug on the locking cylinder; and a limiting tab formed on the bolt base and selectively abutting the locking bolt;

the bolt base is mounted at a position corresponding to the locking cylinder; and the pushing element selectively engages and is driven by the pushing lug of the locking cylinder.

3. The lock assembly as claimed in claim 2, wherein the bolt base has a base slot defined longitudinally through the bolt base;

the body further has a guiding rod formed on and protruding from the body and extending slidably into the base slot in the bolt base; and the pushing element further has an elongated guiding channel mounted slidably around the guiding rod on the body.

4. The lock assembly as claimed in claim 3, wherein the pushing element further has a notch defined in an edge of the pushing element and selectively engaging the pushing lug on the locking cylinder.

5. The lock assembly as claimed in claim 4, wherein the locking bolt further has a bolt slot defined longitudinally through the locking bolt and being parallel with the base slot in the bolt base; and the lever element further has a driving rod protruding from the lever element at an end opposite to the pivotal hole and extending slidably into the bolt slot in the locking bolt.

6. The lock assembly as claimed in claim 2, wherein the locking bolt further has a bolt slot defined longitudinally through the locking bolt and being parallel with the base slot in the bolt base; and the lever element further has a driving rod protruding from the lever element at an end opposite to the pivotal hole and extending slidably into the bolt slot in the locking bolt.

7. The lock assembly as claimed in claim 2, wherein the locking bolt further has a bolt slot defined longitudinally through the locking bolt and being parallel with the base slot in the bolt base; and the lever element is elongated and has a first end pivotally connected to the body; and a driving rod protruding from the lever element at a second end opposite to the first end and extending slidably into the bolt slot in the locking bolt.

8. The lock assembly as claimed in claim 1, wherein the bolt base has a base slot defined longitudinally through the bolt base;

the body further has a guiding rod formed on and protruding from the body and extending slidably into the base slot in the bolt base; and the pushing element further has an elongated guiding channel mounted slidably around the guiding rod on the body.

9. The lock assembly as claimed in claim 8, wherein the pushing element further has a notch defined in an edge of the pushing element and selectively engaging the pushing lug on the locking cylinder.

10. The lock assembly as claimed in claim 9, wherein the locking bolt further has a bolt slot defined longitudinally through the locking bolt and being parallel with the base slot in the bolt base; and the lever element further has a driving rod protruding from the lever element at an end opposite to the pivotal hole and extending slidably into the bolt slot in the locking bolt.

11. The lock assembly as claimed in claim 1, wherein the pushing element further has a notch defined in an edge of the pushing element.

12. The lock assembly as claimed in claim 2, wherein the pushing element further has a notch defined in an edge of the pushing element and selectively engaging the pushing lug on the locking cylinder.

13. The lock assembly as claimed in claim 1, wherein the locking bolt further has a bolt slot defined longitudinally through the locking bolt and being parallel with the base slot in the bolt base; and the lever element further has a driving rod protruding from the lever element at an end opposite to the pivotal hole and extending slidably into the bolt slot in the locking bolt.

14. The lock assembly as claimed in claim 1, wherein the locking bolt further has a bolt slot defined longitudinally through the locking bolt and being parallel with the base slot in the bolt base; and the lever element is elongated and has a first end pivotally connected to the body; and a driving rod protruding from the lever element at a second end opposite to the first end and extending slidably into the bolt slot in the locking bolt.

* * * * *